United States Patent [19]

Apps

[11] Patent Number: 4,759,451

[45] Date of Patent: Jul. 26, 1988

[54] MULTI-LEVEL-STACKING/NESTING TRAY

[75] Inventor: William P. Apps, Fullerton, Calif.

[73] Assignee: Rehrig-Pacific Company, Inc., Los Angeles, Calif.

[21] Appl. No.: 878,337

[22] Filed: Jun. 25, 1986

[51] Int. Cl.[4] ..... A47F 3/14

[52] U.S. Cl. ..... 211/126; 211/194; 206/505; 206/507

[58] Field of Search ..... 211/126, 194; 206/507, 206/505

[56] References Cited

U.S. PATENT DOCUMENTS

| | | | |
|---|---|---|---|
| 249,185 | 8/1878 | Carroll et al. . | |
| 261,069 | 9/1881 | Munch et al. . | |
| 3,113,680 | 12/1963 | Frater et al. | 211/126 |
| 3,219,232 | 11/1965 | Wilson . | |
| 3,404,804 | 10/1968 | Frater et al. | 206/505 |
| 3,405,810 | 10/1968 | Rogus . | |
| 3,534,866 | 10/1970 | Asenbauer . | |
| 4,102,453 | 7/1978 | Carroll et al. . | |
| 4,238,032 | 12/1980 | Thurman . | |
| 4,320,837 | 3/1982 | Carroll et al. | 206/507 X |
| 4,334,616 | 6/1982 | Wilson . | |
| 4,440,302 | 4/1984 | Ehrman et al. . | |
| 4,520,928 | 6/1985 | Wilson . | |
| 4,523,681 | 6/1985 | Kreeger . | |
| 4,570,798 | 2/1986 | Wilson | 206/505 |

FOREIGN PATENT DOCUMENTS

| | | | |
|---|---|---|---|
| 1402057 | 5/1965 | France | 206/507 |

*Primary Examiner*—Ramon O. Ramirez
*Assistant Examiner*—Blair M. Johnson
*Attorney, Agent, or Firm*—Banner, Birch, McKie & Beckett

[57] ABSTRACT

A multi-level stacking/nesting tray is disclosed in which the trays are configured to permit multi-level stacking through an interlocking stacking leg/slot configuration. A plurality of slots are formed at an angle from the vertical and are disposed in groups in two end locations of two opposing end walls of the tray. The slots in a selected group have progressively lower terminating points to thus permit varying levels of stacking/nesting. The slots are also configured so that the terminating point of each of the slots with a group lies along the same vertical line. Stacking legs are disposed on the exterior surface of the end walls of the tray at the location of the slots and are appropriately angled so as to permit insertion of the legs of a first tray into the corresponding slots of a second tray positioned below the first tray. By proper selection of a particular slot having the desired terminating point, various levels of stacking may be obtained.

12 Claims, 8 Drawing Sheets

MULTI-LEVEL-STACKING/NESTING TRAY

BACKGROUND OF THE INVENTION

A typical prior art stacking and nesting container is disclosed in U.S. Pat. No. 3,113,680 to Frater. Frater discloses a container having a slanting trough in each side wall which is formed by projecting a portion of the side wall outwardly. The containers can be stacked vertically on top of one another by resting the trough of the upper container on a support or stacking point of the lower container. The upper container may be nested within the lower by longitudinally shifting the upper container to fit the trough of the upper container into the trough of the lower container. The primary disadvantage of such a construction is that it only permits the containers to be in two positions, i.e., stacked or nested, and does not permit multi-level stacking.

U.S. Pat. No. 3,404,804, also to Frater, partially solves this problem by modifying the troughs to include various levels of stacking points which are used to support closed ends of a trough in a like upper container in various stacking positions. However, this container suffers from lack of stability and the upper container may easily slip from one level to another.

SUMMARY OF THE INVENTION

It is an object of the present invention to provide a multi-level stacking/nesting tray which provides a wide variety of stacking levels.

It is further an object of the present invention to provide a multi-level stacking/nesting tray with increased stability at each level.

The present invention is directed to a multi-level stacking/nesting tray configured to permit multi-level stacking by an interlocking stacking leg/slot configuration. In a preferred embodiment, plurality of substantially parallel slots are formed at an angle from the vertical and are disposed in groups in two end locations in two opposing end walls of the tray. The slots in a selected group have progressively lower terminating points to thus permit varying levels of stacking/nesting. The slots are also configured so that the terminating point of each of the slots of a particular group lies substantially along the same vertical line. Stacking legs extend from the exterior surface of the end walls of the tray at the location of the slots and are appropriately angled so as to permit insertion of the legs of the first tray into the slots of a second tray positioned below the first tray. By proper selection of the corresponding slots having the desired terminating point, various levels of stacking/nesting may be obtained.

DETAILED DESCRIPTION OF THE PREFERRED EMBODIMENT

Figure 4:
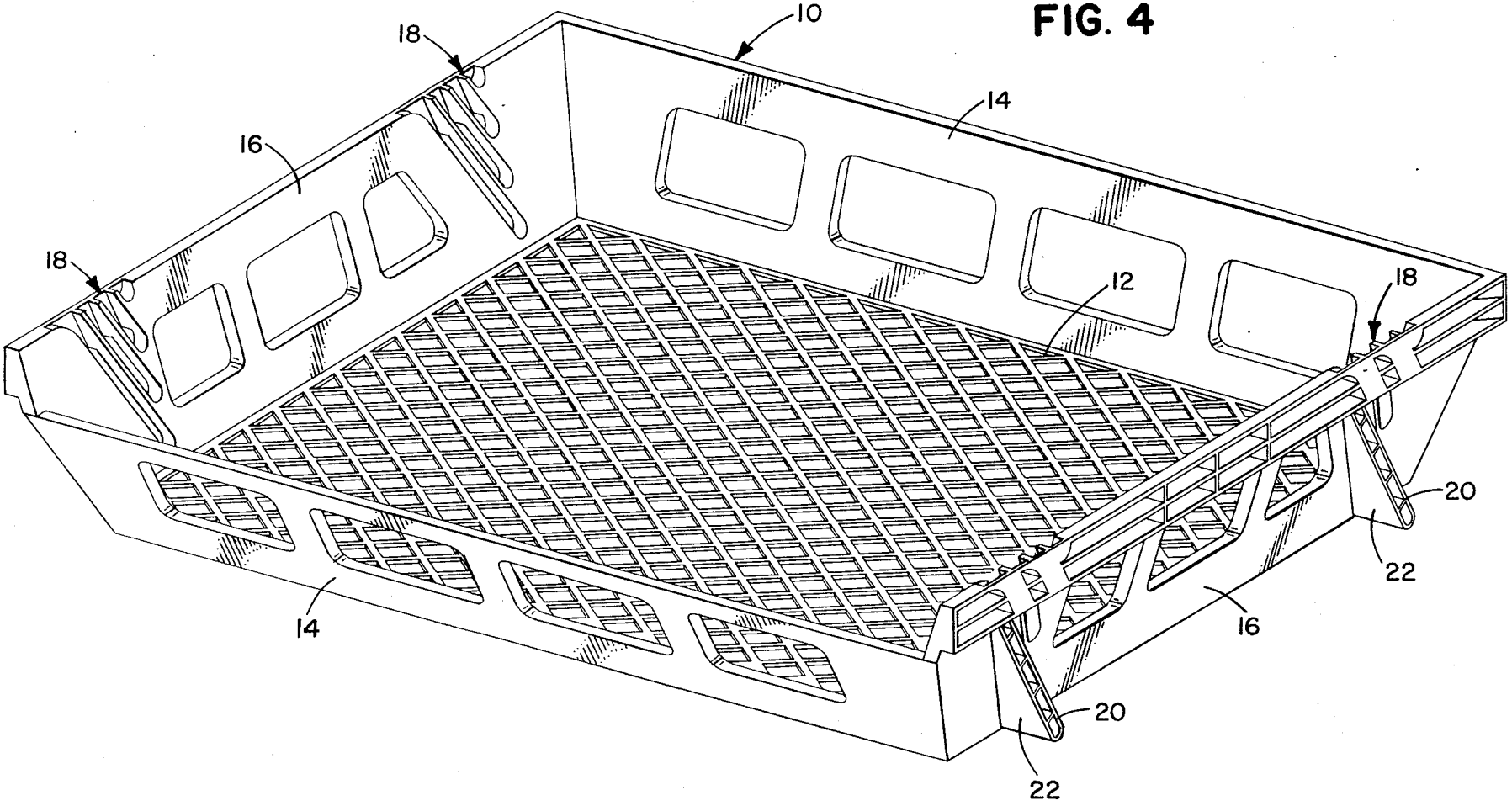
FIG. 4 is a perspective view of a tray in accordance with the first embodiment of the invention incorporating four stacking slots.
Figure 5:
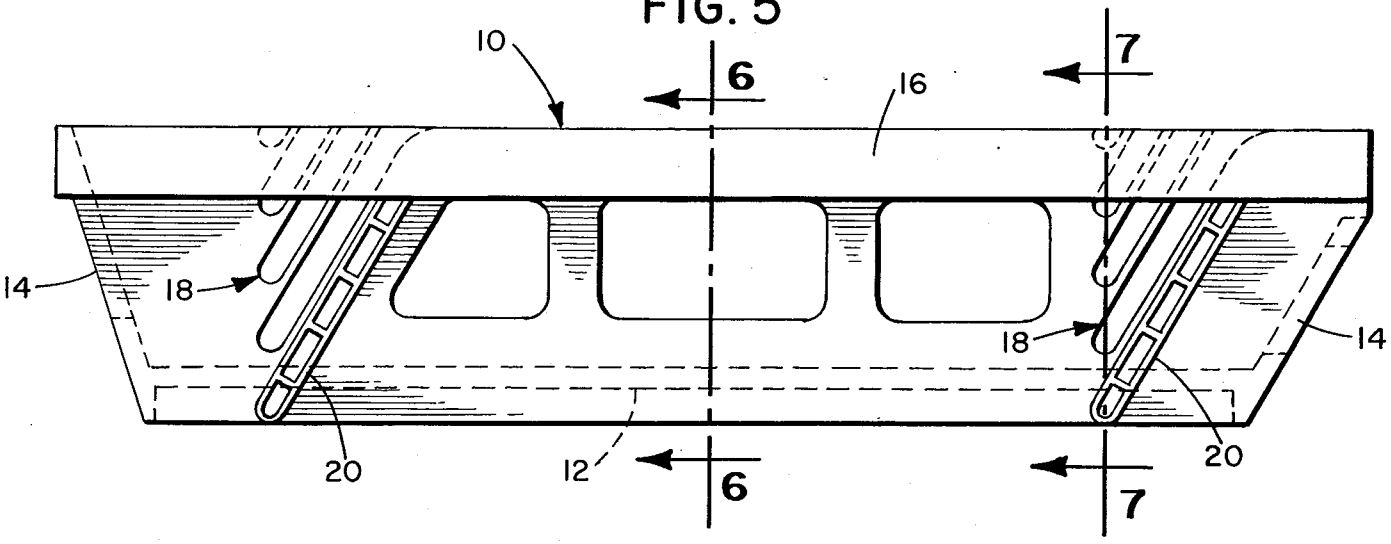
FIG. 5 is an end elevational view of the four-slot embodiment illustrated in FIG. 4.
Figure 6:
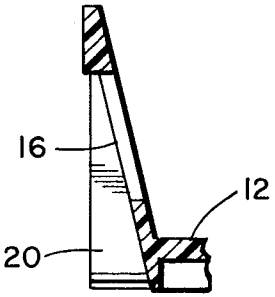
FIG. 6 is a cross sectional view of the four-slot embodiment of FIG. 5 taken along line 6—6 of FIG. 5.
Figure 7:
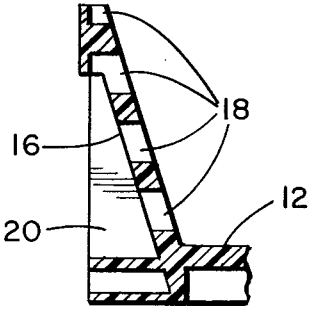
FIG. 7 is a cross-sectional view of the four-slot embodiment of FIG. 5 taken along line 7—7 of FIG. 5.
Figure 8:
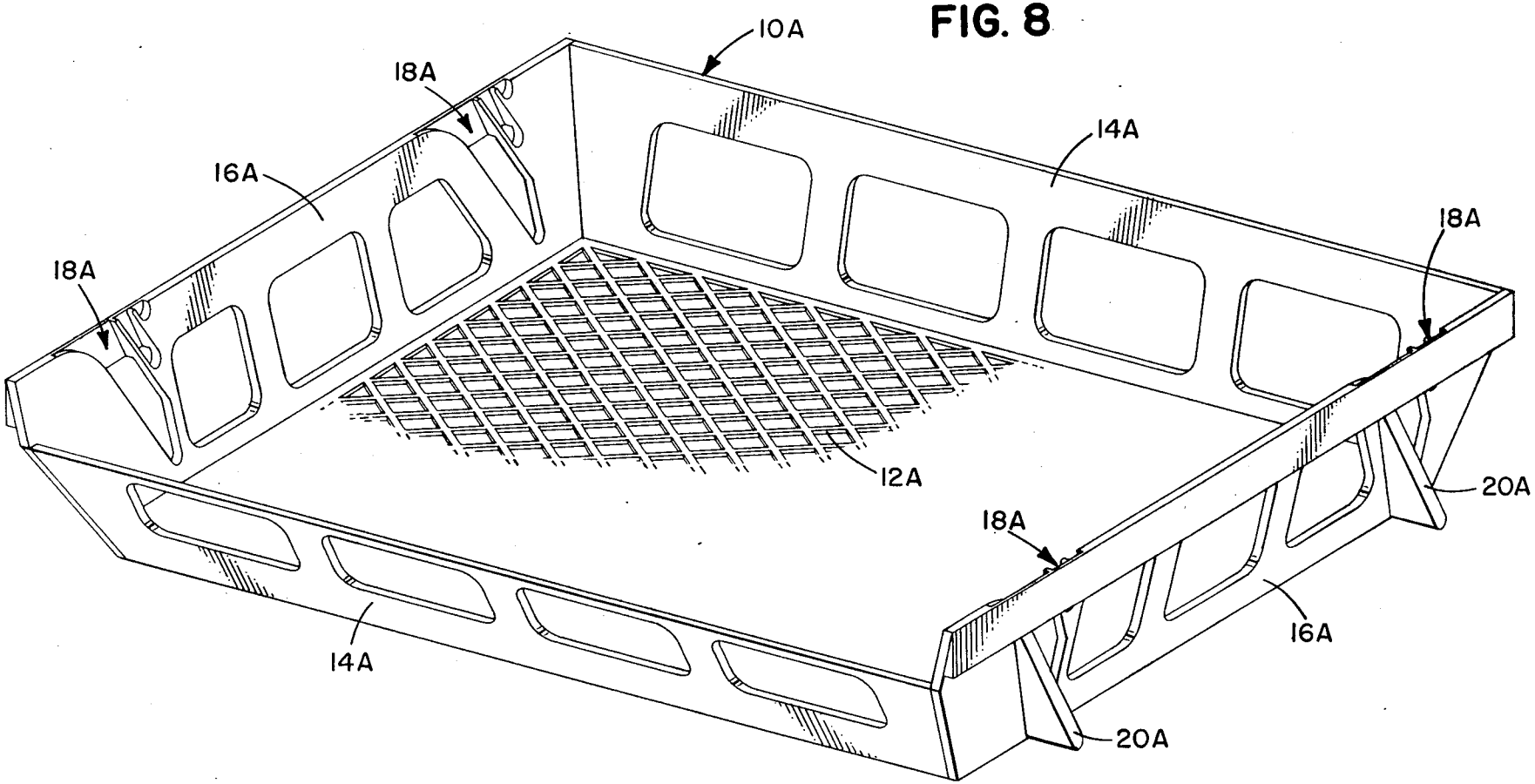
FIG. 8 is a perspective view of a tray in accordance with the second embodiment of the present invention incorporating three stacking slots.
Figure 9:
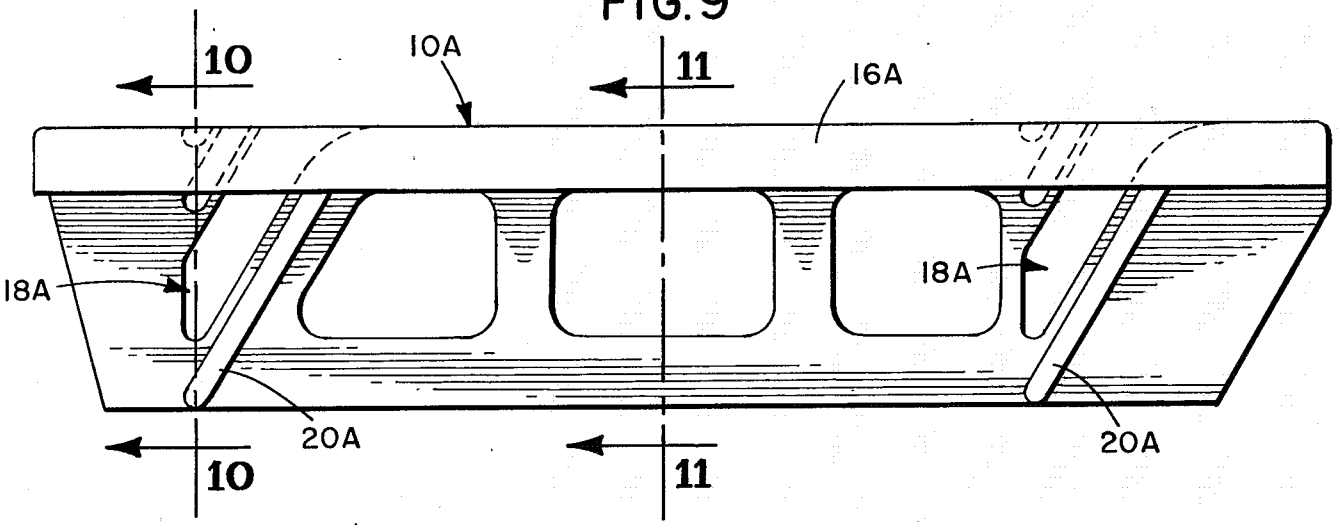
FIG. 9 is an end elevational view of the three slot embodiment illustrated in FIG. 8.
Figure 11:
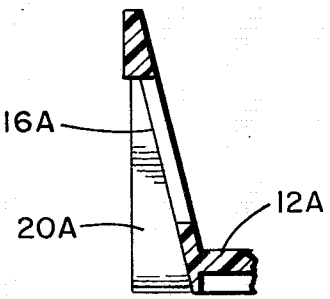
FIG. 11 is a cross-sectional view of the three-slot embodiment of FIG. 9 taken along line 11—11 of FIG. 9.
Figure 10:
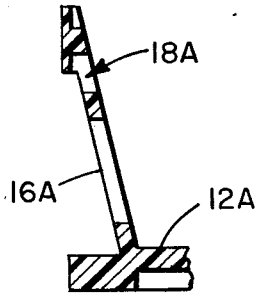
FIG. 10 is a cross-sectional view of the three-slot embodiment illustrated in FIG. 9 taken along line 10—10 of FIG. 9.

A multi-level stacking/nesting tray in accordance with the first embodiment of the present invention is best illsutrated in FIG. 4 and generally designated 10. In the figures, like numerals will be used to designate like elements. Tray 10 includes preferably rectangular base 12, upwardly extending longitudinal side walls 14 and upwardly extending transverse end walls 16 forming an upwardly open receptacle. Base 12 is preferably formed of a honeycomb/cellular plastic, although it is contemplated that other materials may be used. Likewise, side walls 14 and end walls 16 are preferably formed of cellular plastic with a cross-section illustrated in FIGS. 7 and 10, although other material may be used. At least one of the side walls or end walls should be flared slightly outwardly to facilitate ease of stacking and nesting.

Set of substantially parallel slots 18 is formed in each end portion of end walls 16. A four-slot configuration is illustrated in FIGS. 1–7, although other numbers of slots may be used, such as the three-slot embodiment illustrated in FIGS. 8–15. The three-slot embodiment is substantially the same as the four-slot embodiment and the corresponding elements have the same reference numbers, with the addition of the letter "A" to the illustrations of the three-slot embodiment. Each slot extends at an angle downwardly from the upper surface of the end wall to a terminating point above the base. Each slot within set of slots 18 has a progressively lower terminating point to permit varying levels of stacking/nesting, as will be further discussed. Moreover, each slot within each set of slots has a terminating point substantially coinciding with a single vertical line. It should be noted that each set of slots 18 is substantially identical, particularly with regard to the angle of the slots and the length of the slots. Furthermore, the distance between the slots in each set of slots should be substantially the same and approximately equal to the distance between the bases of the containers when in their rested configuration. Otherwise, only two containers can be nested in a single stack.

Figure 1:
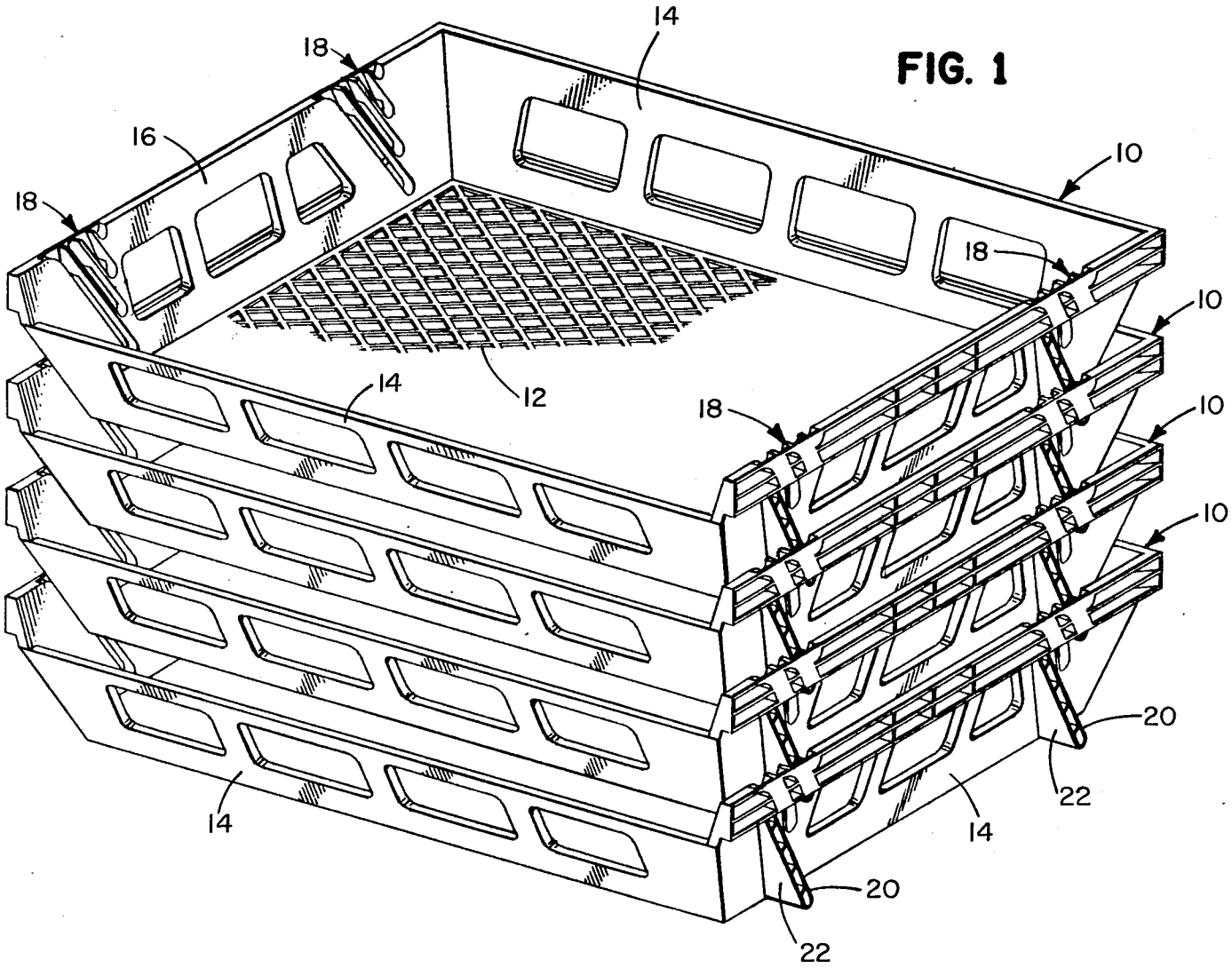
FIG. 1 is a perspective view illustrating a plurality of trays of the present invention stacked in a low-stacked configuration.
Figure 2:
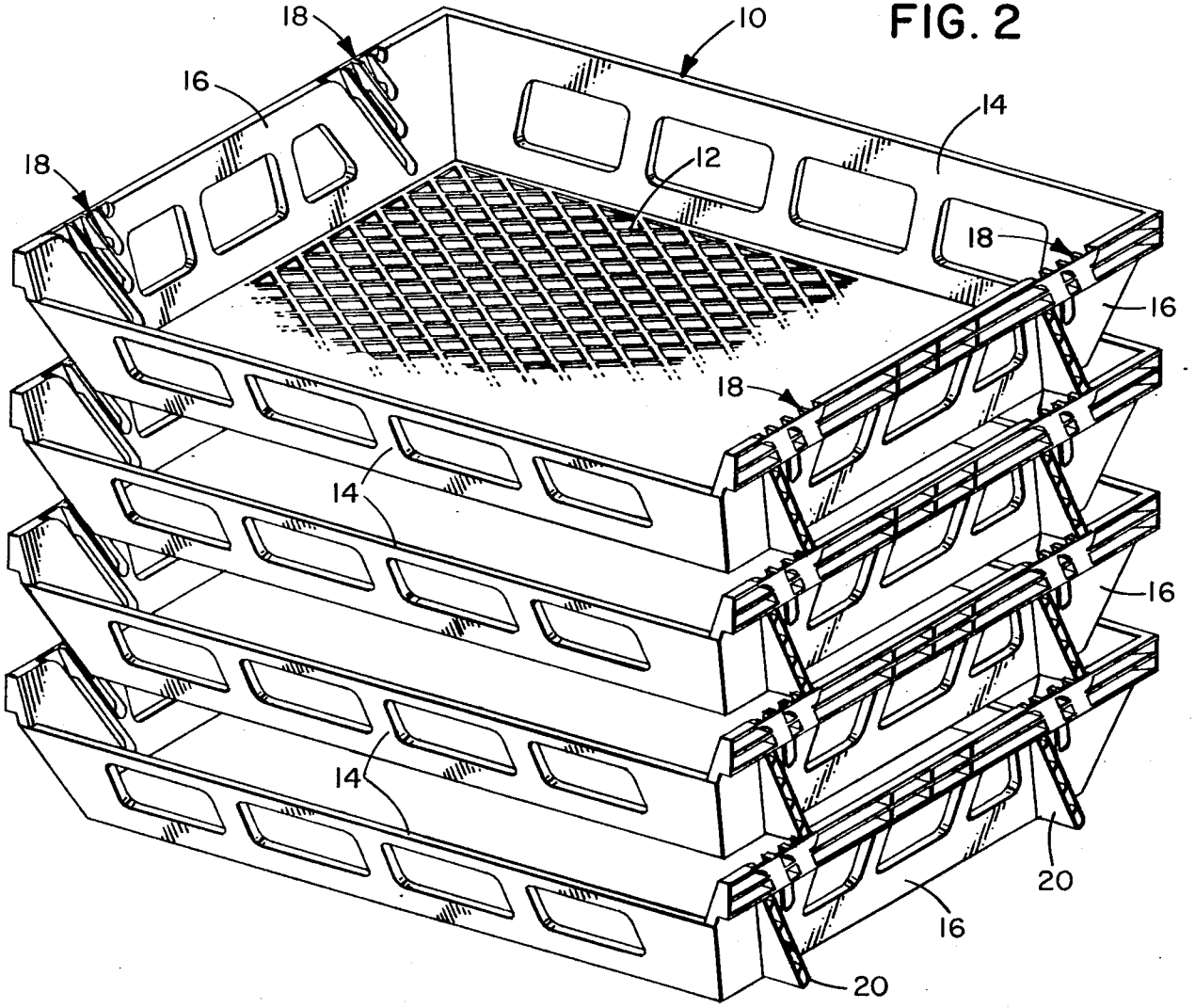
FIG. 2 is a perspective view illustrating the trays of the present invention stacked in a high-stack configuration.
Figure 3:
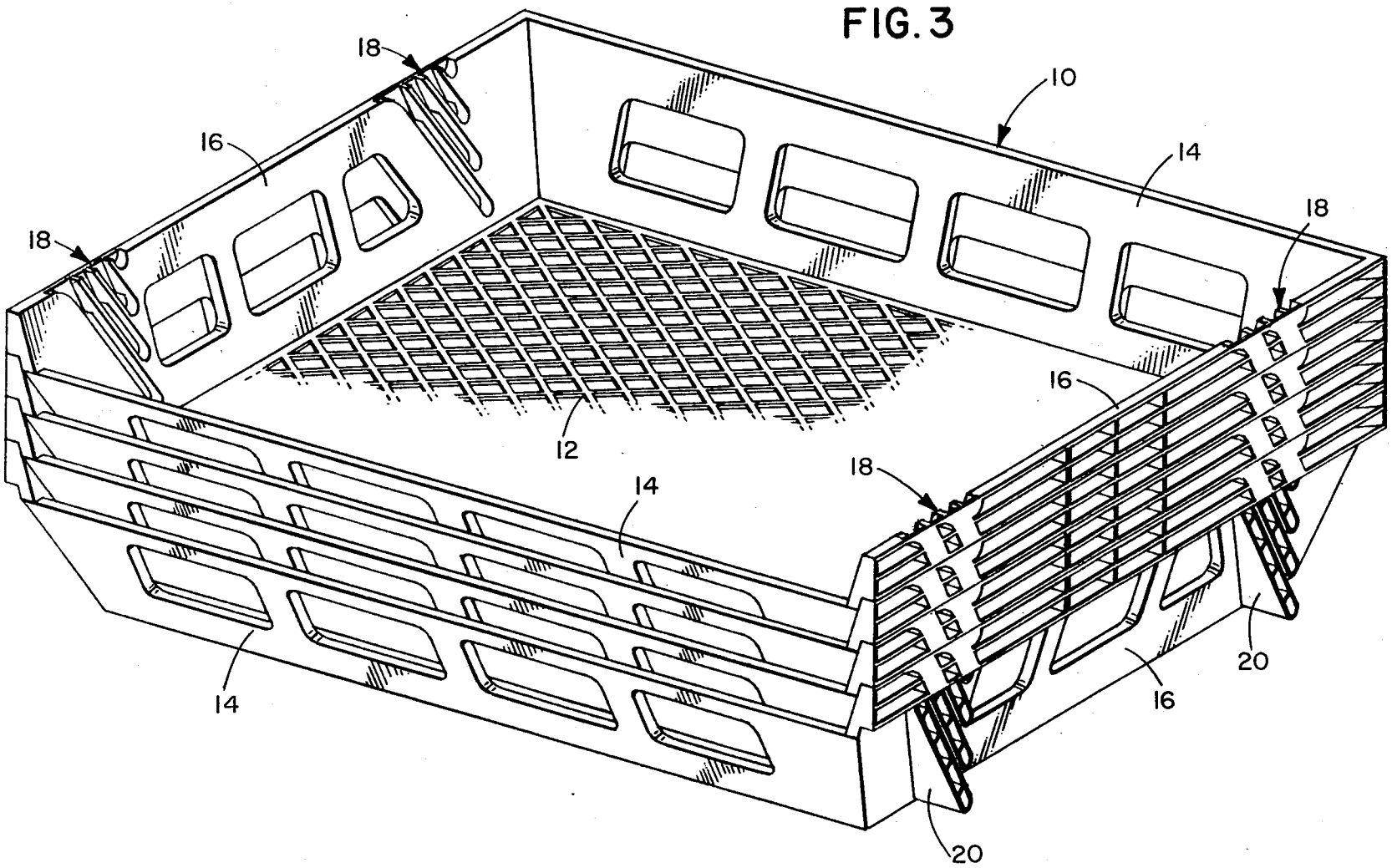
FIG. 3 is a perspective view of the trays of the present invention stacked in a nested configuration.
Figure 12:
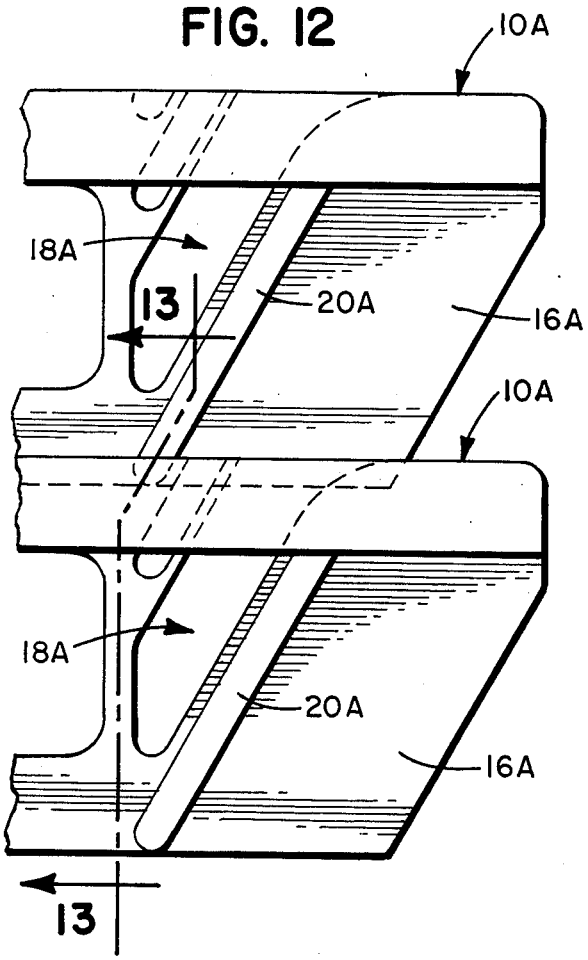
FIG. 12 is an elevational view of two trays as shown in FIG. 9 in a high-stack configuration.
Figure 14:
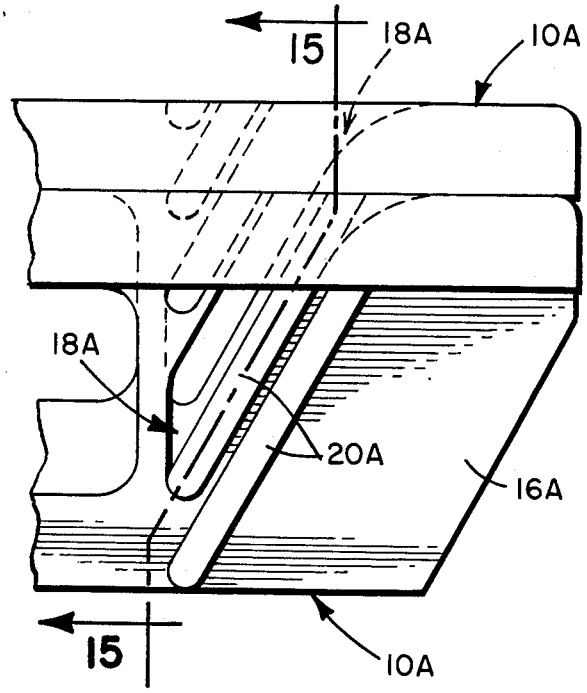
FIG. 14 is an elevational view of two trays as shown in FIG. 4 in a nested configuration.
Figure 13:
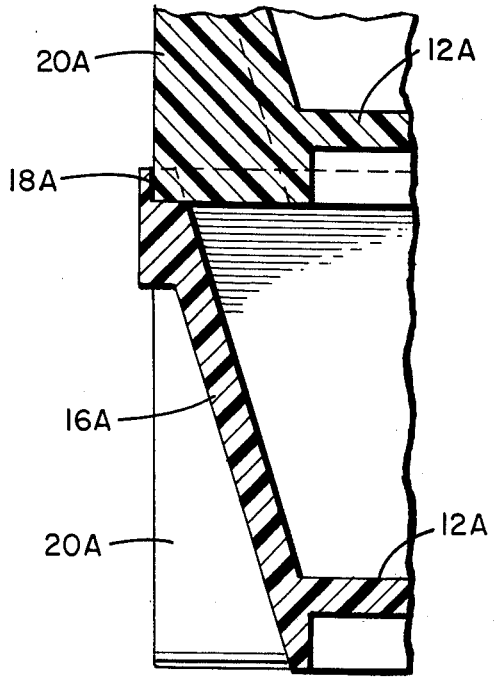
FIG. 13 is a cross-sectional view of the high-stack configuration shown in FIG. 12 taken along line 13—13 of FIG. 12.
Figure 15:
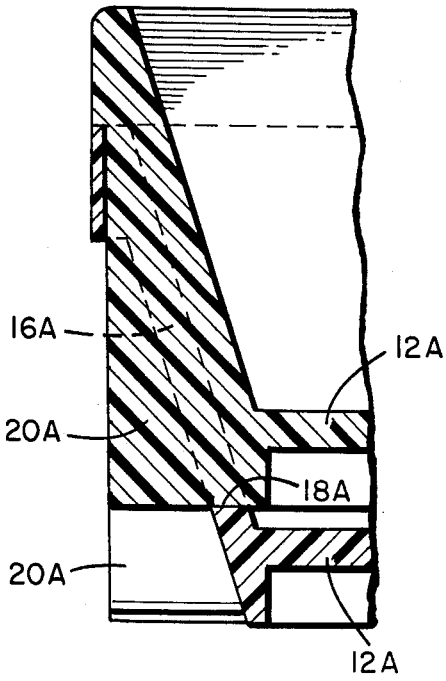
FIG. 15 is a cross-sectional view of the nested configuration shown in FIG. 14 taken along line 15-15 of FIG. 14.

Stacking legs 20 extend outwardly from the outside surface of end walls 16 at approximately the location of their corresponding set of slots 18 while remaining distinct from the slots to add stability. The legs are formed with triangularly-shaped faces 22 with an interior preferably formed of cellular plastic to provide strength and rigidity. Legs 20 are appropriately angled to permit insertion of the legs of one tray into the corresponding slots of a second tray positioned below the first. As can be seen in FIGS. 2 and 12, when the legs are placed in the corresponding uppermost slot of each set of slots, the trays are stacked in a high-stacked configuration, i.e., there is the maximum distance between adjacent tray bases. As seen in FIG. 1, when the legs are placed in a corresponding lower slot of each set of slots, the trays are stacked in a low-stacked configuration. Finally, as seen in FIG. 3, when the legs are placed in the corresponding lowermost slot of each set of slots, the trays are nested within each other in their most compact configuration. Clearly, the number of slots in each set determines the number of levels available.

The foregoing description is for a illustrative purposes only. It is contemplated that changes may be made, particularly with regard to matters of shape size and arrangement of parts, within the scope of the invention as defined by the broad, general meaning of the terms in which the appended claims are expressed. For example, it is contemplated that at least one pair of the leg/slot configurations could be formed in the opposing side walls instead of the end walls. For example, it is further contemplated that the angles of the leg/slot configurations may be designed to suit the needs of the user.

What is claimed is:

1. A multi-level stacking/nesting tray comprising:

a base having a plurality of upwardly extending walls forming an upwardly open receptacle, each of said walls having an interior surface and an opposing exterior surface;

a first set of substantially parallel, angled, slots formed in one of said walls and a second set of substantially parallel, angled, slots formed in a second wall, each slot in each of said sets having an upper end being open adjacent a top edge of the respective wall and having a progressively lower closed terminating end to permit varying levels of stacking/nesting and said closed terminating ends of each slot of each of said sets substantially aligned along a single vertical axis relative to said base, thereby defining slots having different lengths within each set, the length of each slot of said first set being substantially the same length as a corresponding slot of said second set; and a first stacking leg extending outwardly from an exterior surface of one wall and a second stacking leg extending outwardly from an exterior surface of said second wall, wherein said legs are adapted for insertion into a corresponding slot of each set of a similar tray.

2. A multi-level tray as in claim 1 further comprising:

a third set of substantially parallel, angled, slots being substantially the same as the slots of said first and second sets of slots formed in one of said walls and being spaced from said first set, each slot of said third set also having a progressively lower closed terminating end to permit varying levels of stacking/nesting and said terminating end of each slot in said third set also substantially aligned along a single vertical axis relative to said base; and a third stacking leg being substantially the same as said first and second stacking legs and extending outwardly from one of said walls, wherein said third leg is also adapted for insertion of said third leg into a corresponding slot of a third set of slots of a similar tray.

3. A multi-level tray as in claim 2 further comprising:

a fourth set of substantially parallel, angled, slots being substantially the same as the slots of said first and second set of slots formed in one of said walls and being spaced from said first set, each slot of said fourth set also having a progressively lower closed terminating end to permit varying levels of stacking/nesting and said terminating points of each slot in said fourth set also substantially coinciding with a single vertical axis; and a fourth stacking leg being substantially the same as said first and second stacking legs and extending outwardly from said second wall, wherein said fourth leg is adapted for insertion of said fourth leg into a corresponding slot of a fourth set of slots of a similar tray.

4. A multi-level tray as in claim 1 wherein at least one of said walls flares outwardly to facilitate ease of stacking/nesting.

5. A multi-level tray as in claim 3 wherein said third and fourth stacking legs are angled to permit insertion of said third and fourth legs into the corresponding third and fourth sets of slots of a similar tray.

6. A multi-level tray as in claim 1 wherein said first and second legs are triangularly-shaped.

7. A multi-level tray as in claim 3 wherein said legs are triangularly-shaped.

8. A multi-level tray as in claim 1 wherein the distance between adjacent terminating ends in said first and second set is substantially the same.

9. A multi-level tray as in claim 3 wherein the distance between adjacent terminating points in said sets is substantially the same.

10. A multi-level stacking/nesting device comprising:

a base having a plurality of walls extending upwardly therefrom forming an upwardly open receptacle, each of said walls having an interior surface and an opposing exterior surface;

a plurality of slots formed in at least one of said walls;

at least one stacking leg extending outwardly from an exterior surface of at least one of said walls;

wherein said leg is adapted for insertion into slots of a similar tray; and further wherein said leg and said slots are formed independent of each other;

wherein said plurality of slots comprises a plurality of groups of slots, each group being comprised of at least two slots;

wherein each slot has a terminating surface and said terminating surface of each successive slot in a group of slots is lower than the terminating surface of a preceding slot in that group to permit varying levels of stacking/nesting and further wherein at least a portion of each terminating surface of each slot of a group of slots is aligned along a single vertical axis.

11. A multi-level stacking/nesting device as claimed in claim 10 wherein said leg projects from an inside surface of said wall.

12. A multi-level stacking/nesting device as claimed in claim 10 wherein said leg is substantially solid.

* * * * *